US010612195B2

(12) United States Patent
López Bueno et al.

(10) Patent No.: US 10,612,195 B2
(45) Date of Patent: Apr. 7, 2020

(54) PROCEDURE FOR LAYING RAILWAY TRACKS

(71) Applicant: FERROVIAL AGROMAN, S.A., Madrid (ES)

(72) Inventors: Fernando María López Bueno, Madrid (ES); Rodolfo Moreno Pérez, Madrid (ES); Miguel Ángel Valencia Arévalo, Madrid (ES)

(73) Assignee: FERROVIAL AGROMAN, S.A., Madrid (ES)

( * ) Notice: Subject to any disclaimer, the term of this patent is extended or adjusted under 35 U.S.C. 154(b) by 635 days.

(21) Appl. No.: 15/303,495

(22) PCT Filed: Apr. 9, 2015

(86) PCT No.: PCT/ES2015/070279
§ 371 (c)(1),
(2) Date: Oct. 11, 2016

(87) PCT Pub. No.: WO2015/155399
PCT Pub. Date: Oct. 15, 2015

(65) Prior Publication Data

US 2017/0030023 A1 Feb. 2, 2017

(30) Foreign Application Priority Data

Apr. 11, 2014 (ES) ..... 201430549

(51) Int. Cl.
*E01B 29/16* (2006.01)
*E01B 29/17* (2006.01)
(Continued)

(52) U.S. Cl.
CPC ..... *E01B 29/16* (2013.01); *E01B 29/13* (2013.01); *E01B 29/17* (2013.01); *E01B 29/20* (2013.01); *E01B 29/44* (2013.01); *E01B 29/46* (2013.01)

(58) Field of Classification Search
CPC ..... E01B 29/05; E01B 29/16; E01B 29/44; E01B 29/46; E01B 29/17; E01B 29/13;
(Continued)

(56) References Cited

U.S. PATENT DOCUMENTS 2,861,359 A * 11/1958 Kershaw ..... E01B 27/025 37/104
3,451,349 A * 6/1969 Yard ..... E01B 29/13 104/9
(Continued)

FOREIGN PATENT DOCUMENTS

AU 200037783 A * 12/2000 ..... E01B 11/36
EP 2233638 A2 9/2010
(Continued)

OTHER PUBLICATIONS

International Search Report with English translation for Application No. PCT/ES2015/070279 dated Aug. 5, 2015 (6 pages).

*Primary Examiner* — Scott A Browne
(74) *Attorney, Agent, or Firm* — Michael Best & Friedrich LLP

(57) ABSTRACT

A procedure for laying railway tracks on a trackbed on which sleepers (20) are located, that comprises at least the following steps:

a) approach of a track laying train (30) with the stretches of rail (1) to be laid in the laying area;
b) joining of the pairs of rails (1) to the consecutive rails (1) by means of tractor plates (200);
c) unloading the pairs of rails (1) from the track laying train (30) onto the bed;
(Continued)

d) squaring of the sleepers (20) by means of a squaring device;

e) joining of the consecutive pairs of rails (1) by means of a joint plate (100);

f) unloading of ballast in hoppers onto the bed;

g) tamping of the rails (1);

h) profiling of the ballast by means of a profiling device (400);

i) welding of the rails (1).

17 Claims, 9 Drawing Sheets

(51) Int. Cl.

| | |
|---|---|
| ***E01B 29/13*** | (2006.01) |
| ***E01B 29/20*** | (2006.01) |
| ***E01B 29/44*** | (2006.01) |
| ***E01B 29/46*** | (2006.01) |

(58) Field of Classification Search
CPC ..... E01B 29/20; E01B 11/02; E01B 27/02; E01B 33/00
USPC ..... 104/5
See application file for complete search history.

(56) References Cited

U.S. PATENT DOCUMENTS

| | | | | |
|---|---|---|---|---|
| 3,605,297 | A * | 9/1971 | Kershaw | E01B 27/025 37/105 |
| 5,617,793 | A * | 4/1997 | Theurer | E01B 27/13 104/12 |
| 8,006,624 | B2 * | 8/2011 | Sin | E01B 29/16 104/2 |
| 9,957,669 | B2 * | 5/2018 | Ruiz Escalante | E01B 11/02 |
| 10,138,605 | B2 * | 11/2018 | Bartolome Asensio | E01B 29/13 |
| 2010/0116166 | A1 * | 5/2010 | Aguirre Fernandez | E01B 29/16 104/2 |
| 2015/0144020 | A1 * | 5/2015 | Castano Vega | E01B 29/16 104/2 |

FOREIGN PATENT DOCUMENTS

| | | | | | |
|---|---|---|---|---|---|
| EP | 2503058 | A1 | | 9/2012 | |
| ES | 1073783 | U | * | 2/2011 | E01B 11/08 |
| FR | 2253874 | A1 | | 7/1975 | |
| GB | 2159560 | A | | 12/1985 | |
| SU | 751880 | A1 | * | 7/1980 | E01B 29/13 |
| SU | 751880 | A1 | | 7/1980 | |
| WO | 2007053020 | A1 | | 5/2007 | |
| WO | 2013178845 | A1 | | 12/2013 | |
| WO | WO-2013178845 | A1 | * | 12/2013 | E01B 29/16 |
| WO | WO-2015155403 | A1 | * | 10/2015 | E01B 11/02 |
| WO | WO-2015155404 | A1 | * | 10/2015 | E01B 11/08 |

* cited by examiner

PROCEDURE FOR LAYING RAILWAY TRACKS

FIELD OF THE INVENTION

The invention refers to a procedure for laying railway tracks; more specifically to the process of unloading, placement and auxiliary works for railway tracks.

BACKGROUND OF INVENTION

The track laying train is the means by which rails habitually reach the railway track laying area, with the rails needing to be unloaded subsequently from the track laying train.

There are basically two methods for unloading the rails. They are differentiated by the fact that in one of them the track laying train advances over the track already laid while the rail is secured at a fixed point at one of its ends and, in the other method, the track laying train remains stationary while the rail is extracted following the track alignment. If the former method is used, a previously laid track is required, i.e. an auxiliary track, which could be a track to be replaced subsequently.

With the latter method, the track laying train remains stationary on the track, which can be the new track previously placed, and the new rails are progressively extracted to be placed as a continuation to the previously laid track.

DESCRIPTION OF THE INVENTION

The procedure for laying railway tracks which is the purpose of the invention is performed on a trackbed on which sleepers are located and comprises at least the following steps:

a) approach of a track laying train with the stretches of rail to be laid in the laying area;
b) joining of pairs of rails to the consecutive rails by means of tractor plates that comprise a support element that comprises a first part and a second part that comprise the corresponding rail gripping elements such that the gripping element is located at each of the faces of the rail web, where the gripping element is able to slide with respect to the support element in the longitudinal direction of the rail, so that when the gripping element is moved in the direction of pull of the rail, it clamps on the rail web;
c) unloading the pairs of rails joined by means of the tractor plates from the track laying train onto the bed;
d) squaring of the sleepers by means of a squaring device that comprises extensible positioning elements located between consecutive sleepers parallel to the direction of the rail and the extension of those positioning elements in the direction parallel to the rail;
e) joining of the consecutive pairs of rails unloaded by means of a joint plate that comprises the corresponding stabilising parts located longitudinally to the rails to be joined, with a top internal surface and a bottom internal surface located in contact with the base of the head and the base of the foot of the rails to be joined and these stabilising parts are subsequently tightened onto the rails to be joined;
f) unloading of ballast in hoppers onto the bed;
g) tamping of the rails;
h) profiling of the ballast by means of a profiling device coupled to an earthmoving machine;
i) welding of the rails.

The first pair of rails can be joined to a pulling machine which moves on the bed to pull the rails while the track laying train remains stationary. Optionally, before unloading the first pair of rails, an unloading tool is mounted on the sleepers to guide the rails, which comprises roller bearings for sliding them.

Another alternative would be to use an auxiliary track parallel to the track being laid and the track laying train would move along this auxiliary track while the ends of the rails to be unloaded would be joined at a fixed point above the sleepers for the track being laid.

In both alternatives, it would be possible for the first pair of rails to be joined to a rail section using the corresponding tractor plates which would be joined to the rail section at one end and to the first rail at the other end. A rail section is essentially a short section of rail.

The procedure which is the purpose of the invention would be applicable both to unloading rails onto the sleepers or to either side of the sleepers.

DESCRIPTION OF THE FIGURES

To complete the description and in order to provide a better understanding of the invention, a set of drawings is provided. These drawings form an integral part of the description and illustrate example embodiments of the invention.

DETAILED DESCRIPTION OF THE INVENTION

Figure 1A:
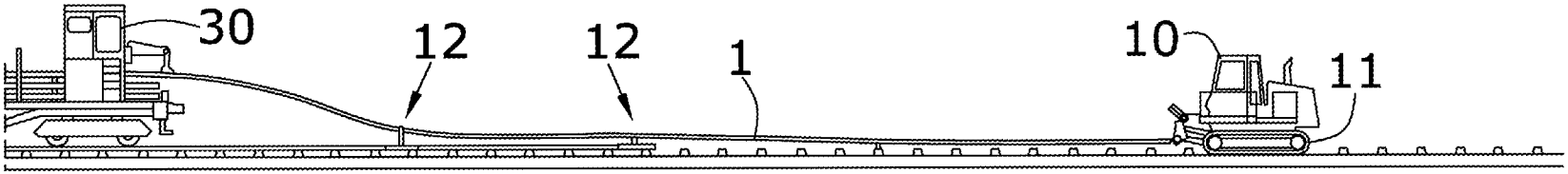
FIG. 1A shows a schematic side view of an example embodiment of the unloading of a first pair of rails from the track laying train without an auxiliary track.

In the railway track laying procedure, the ballast layer is first spread to a thickness of approximately 15 cm. Next, the sleepers (20) are unloaded from the transport platforms, distributing them, for example, every 0.60 m and aligning them by their heads. Next, the way is opened for the track laying train (30) to unload the rails (1) using the appropriate procedures and tools. The problem for laying the rails (1) in laying a new track starts with the arrival of the track laying trains (30) in the laying area, either on the auxiliary track (60) laid for the purpose or on the already laid track. From this time and with the unloading of the rails (1) itself, a series of operations begin with the purpose of putting these elements in place on the sleepers (20).

Figure 1B:
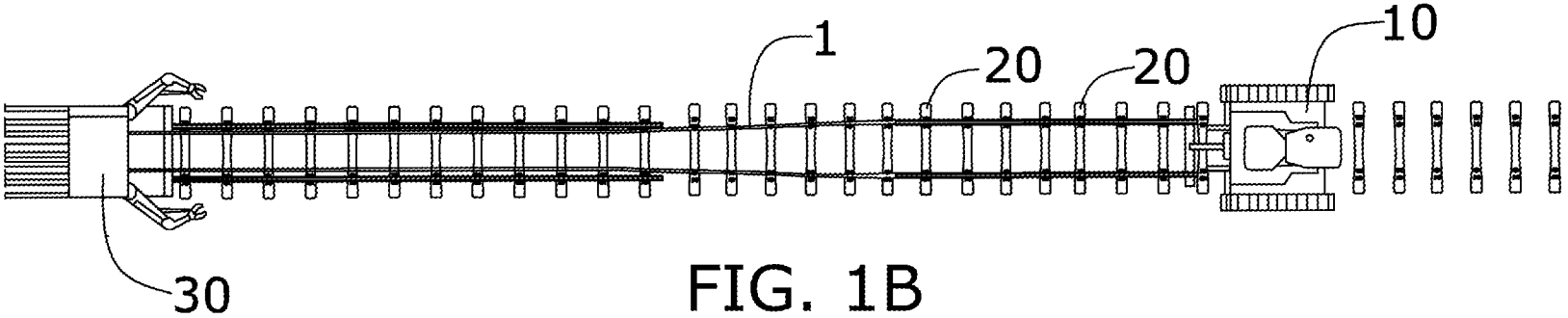
FIG. 1B shows a schematic top view of the embodiment of FIG. 1A.

FIGS. 1A-1B represent an example embodiment of track laying where unloading is performed by means of a pulling machine (10) that moves on the bed while the track laying train (30) remains stationary. In this example embodiment, there is no auxiliary track (60) for laying.

In this example embodiment for unloading the rails (1), the end of the first pair of rails (1) is joined to the pulling machine (10). The pulling machine (10) is capable of moving over the bed with the sleepers (20) previously placed without these or the unloaded and positioned rail (1) itself representing an obstacle to its capability to move and work. To do this, the pulling machine (10) can comprise two caterpillar tracks (11) with their internal faces at least the width of a sleeper (20) apart.

Before unloading the first pair of rails (1), an unloading tool (12) is mounted on the sleepers (20) to guide the rails (1), which comprises roller bearings for sliding them (1).

The invention provides a system for unloading rails (1) that comprises at least one pair of unloading tools (12) that are supported on the sleepers (20), one per rail (1), with each of these unloading tools (12) comprising:

- at least two pairs of horizontal roller bearings and at least two pairs of vertical roller bearings, located in pairs in the top part of the unloading tool (12), with the vertical roller bearings positioned higher up than the horizontal roller bearings; and
- a metal plate frame that comprises a base surface for the horizontal roller bearing supports and for the vertical roller bearing supports and a support at its bottom part to support it on the sleeper (20), which additionally comprises at least two transition platforms coupled above the placed rails (1), with horizontal and vertical roller bearings, with each of these platforms comprising:
- one on-rail (1) support, with a pair of lower longitudinal parts to position it on the already placed rails (1) and means of connection for securing it to them and a pair of vertical posts which are raised centred, one on each longitudinal part;
- a crossbeam that joins the top end of the aforementioned posts and acts as the support for a pair of upper structures containing horizontal and vertical roller bearings;
- a pair of upper structures, each with a base for the corresponding supports for horizontal roller bearings and vertical roller bearings that respectively support at least two pairs of horizontal roller bearings and at least two pairs of vertical roller bearings, arranged in pairs; with each of these structures also comprising a pair of lateral articulated arms, at the top part of which there are the corresponding supports supporting the corresponding vertical roller bearings and at the top ends of which there is a plate that can be coupled to these arms, with the transition platforms being of different heights, reducing in height the further away they are from the track laying train (30) that unloads the rails (1) and which additionally comprises at least one transverse roll bar with the corresponding end clamps each capable of being coupled to its respective rail (1) to be unloaded, maintaining the desired track gauge.

Figure 2:
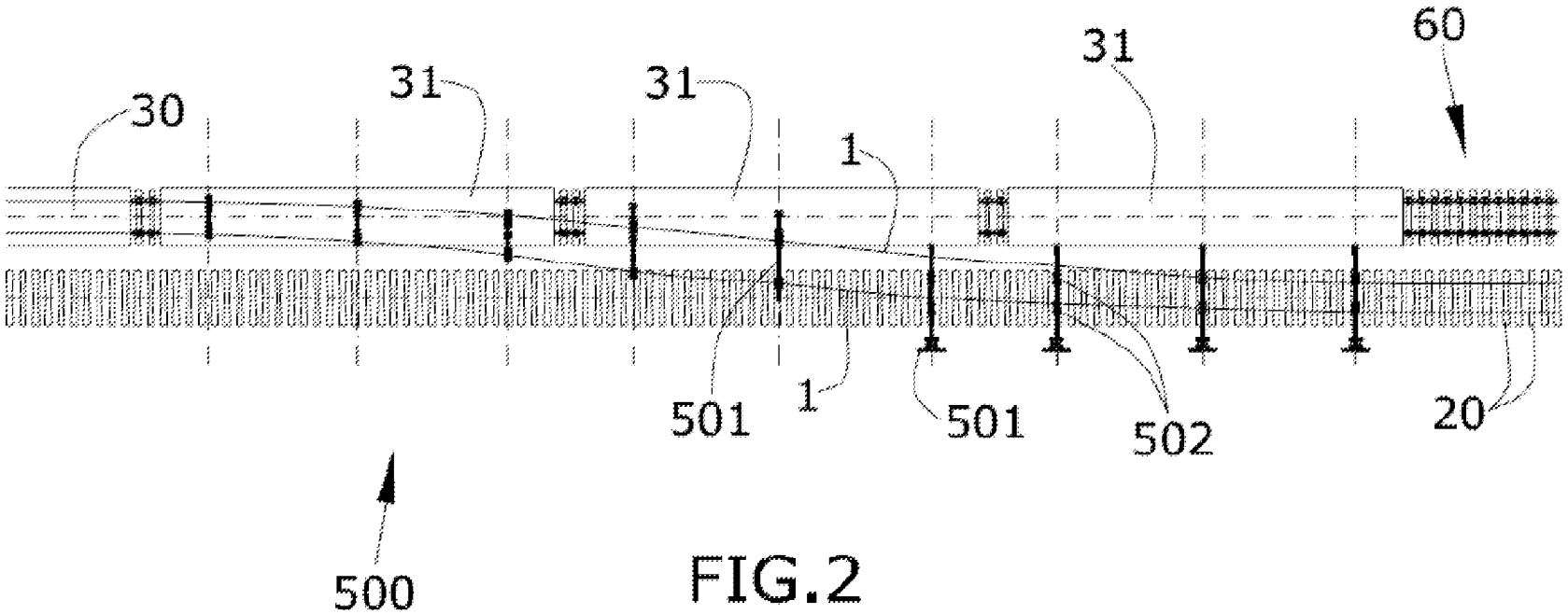
FIG. 2 shows a schematic plan view of an example embodiment of the unloading of rails from an auxiliary track.
Figure 3:
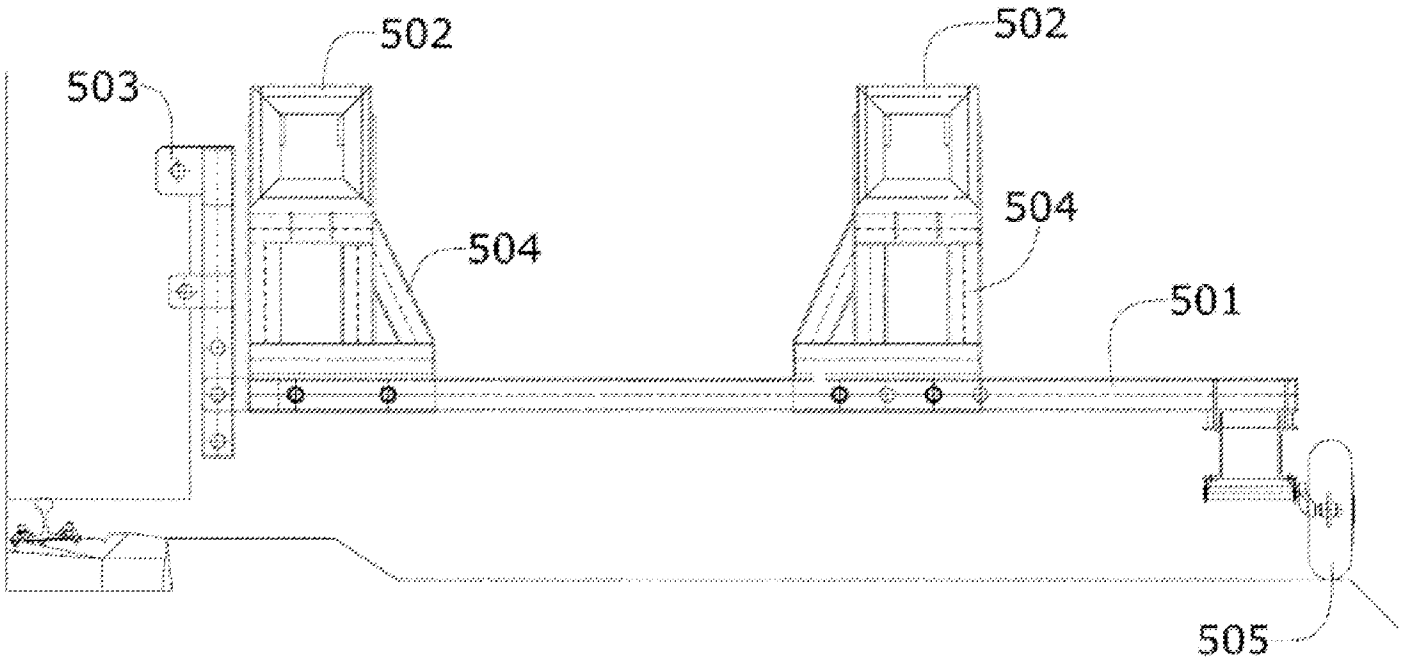
FIG. 3 shows a schematic elevation view of a device for lateral unloading of the rails.

FIG. 2 shows an example embodiment for unloading rails (1) from the track laying train (30) where an auxiliary track (60) parallel to the track being laid is used, while the track laying train (30) moves along this auxiliary track (60) and with the ends of the rails (1) to be unloaded joined to a fixed point on the sleepers (20) for the track being laid.

In this example embodiment the purpose of the unloading device is to unload the rails (1) from the track laying train (30) running on the auxiliary track (60) by clamping successive rails (1) on the track laying train (30) by means of the tractor plate (200) mentioned previously. The rails (1) from the rear of the track laying train (30) are continuously lowered and moved laterally from the train to the track as the track laying train (30) advances.

This device is coupled to a series of auxiliary wagons (31) located at the rear of the track laying train (30) and is constituted of a series of metal structures secured to these auxiliary wagons (31), which set several fixed guidance points for the rails (1), appropriately distributed longitudinally along these auxiliary wagons (31), so that the rails (1) are positioned progressively transversely and longitudinally from their transport position on the track laying train (30) to their final position on the base plate of the sleepers (20) previously also positioned in their final location on the levelled site for the track.

To do this, it comprises a transverse beam (501) across the running direction, onto which the corresponding windows (502) are fixed, fitted internally with rollers through which the rails (1) are guided. The first transverse beam (501) for the first auxiliary wagon (31) located at the rear of the track laying train (30) has its windows (502) centred on the axis of the track laying train (30) and vertically above the auxiliary wagon (31) and, from there, in the following transverse beams (501), these windows (502) are located moved transversely towards the lateral bed where it is intended to lay the track, with the distance being gradually greater in each transverse beam (501). From the central transverse beams (501) of these auxiliary wagons (31) to those located at the rear of the last auxiliary wagon (31), both windows (502) are located outside the auxiliary wagon (31), on a transverse beam (501) in the form of a lateral bracket, located perpendicular to the auxiliary wagon (31) and therefore to the progress of the track laying train (30), fixed at one end to the side of the auxiliary wagon (31) and supported on the ground at the other end by means of wheels (505) that support outside the track, with these supports located on ever lower planes as the transverse beam (501) is located towards the rear of the convoy.

To be able to compensate for possible differences in height between the auxiliary track (60) along which the track laying train (30) runs and the track being laid, the supports for the transverse beams (501) at the side of the auxiliary wagon (31) and at the wheels (505) have means permitting adjustment of their height.

Furthermore, the two windows (502) in the last transverse beam (501) are anticipated to be located vertically over the same axis as the two rails (1) in their final positions, i.e. on the same axis as the sleeper (20) base plates.

The position of the windows (502) on the transverse beam (501) is variable longitudinally to that transverse beam (501). In this way, it is possible to adjust the separation between the windows (502), making it possible to adapt this to an appropriate separation for depositing the rails (1) at the international gauge or the Iberian gauge, also taking into account for adjusting this separation of windows (502) whether the unloading of the rails (1) occurs above the sleepers (20) or onto the bed at each side of the sleepers (20).

To do this, in an example embodiment, the transverse beams (501) are telescopic such that their (501) extension position can be adjusted by means of preset positions, regulating the position in the transverse direction by means of a mechanism and, therefore, regulating the separation between the windows (502).

Similarly, the position of the windows (502) with respect to the transverse beams (501) can be variable as these (501) comprise preset positions, hence the distance between the windows (502) can be varied.

The windows (502) can also be moved vertically, as the transverse beams (501) have preset positions with respect to a vertical bar (503). Additionally, the windows (502) are located on mounts (504) of different thicknesses, which also enable their height to be varied with respect to the transverse beam (501).

Figure 5:
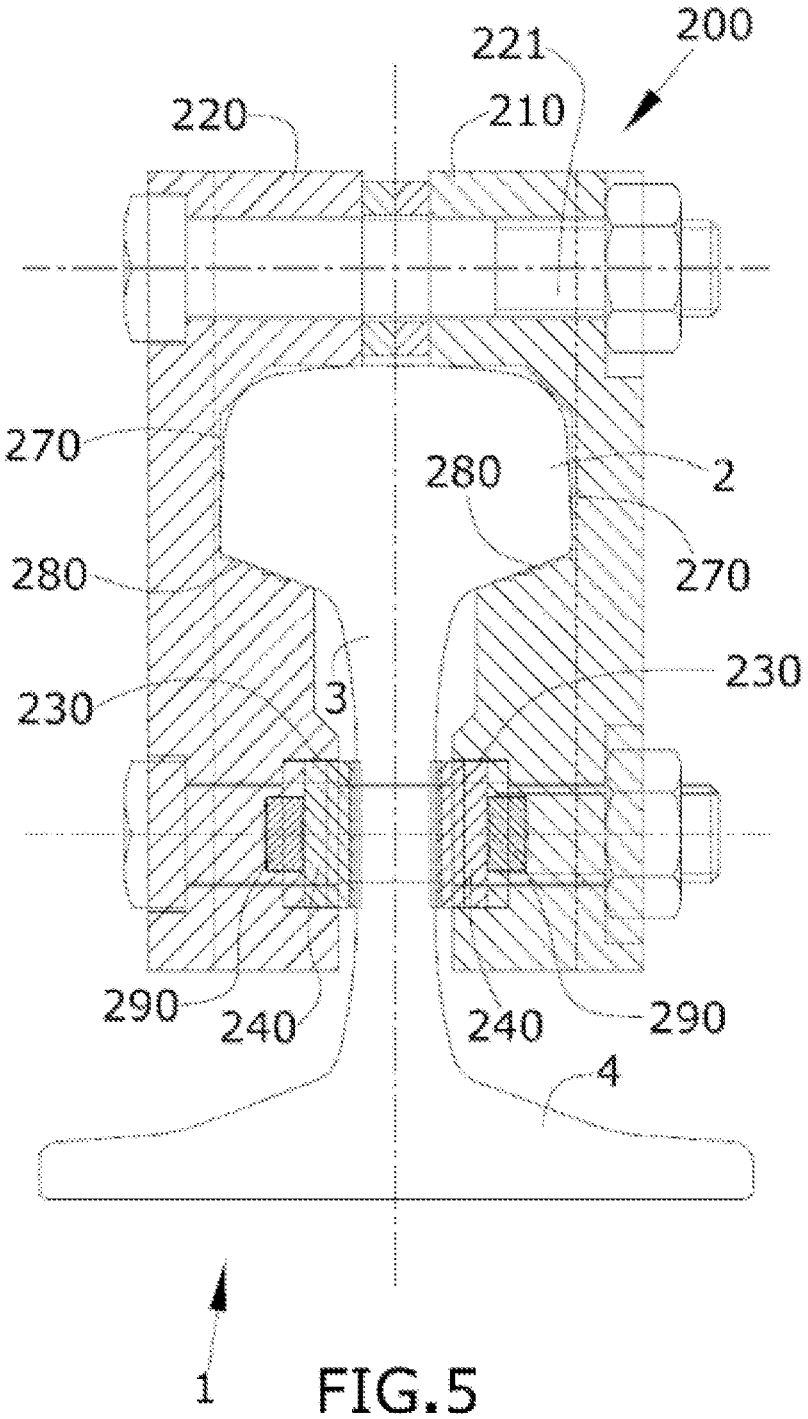
FIG. 5 shows a transverse cross-section view of an example embodiment of a tractor plate.
Figure 6:
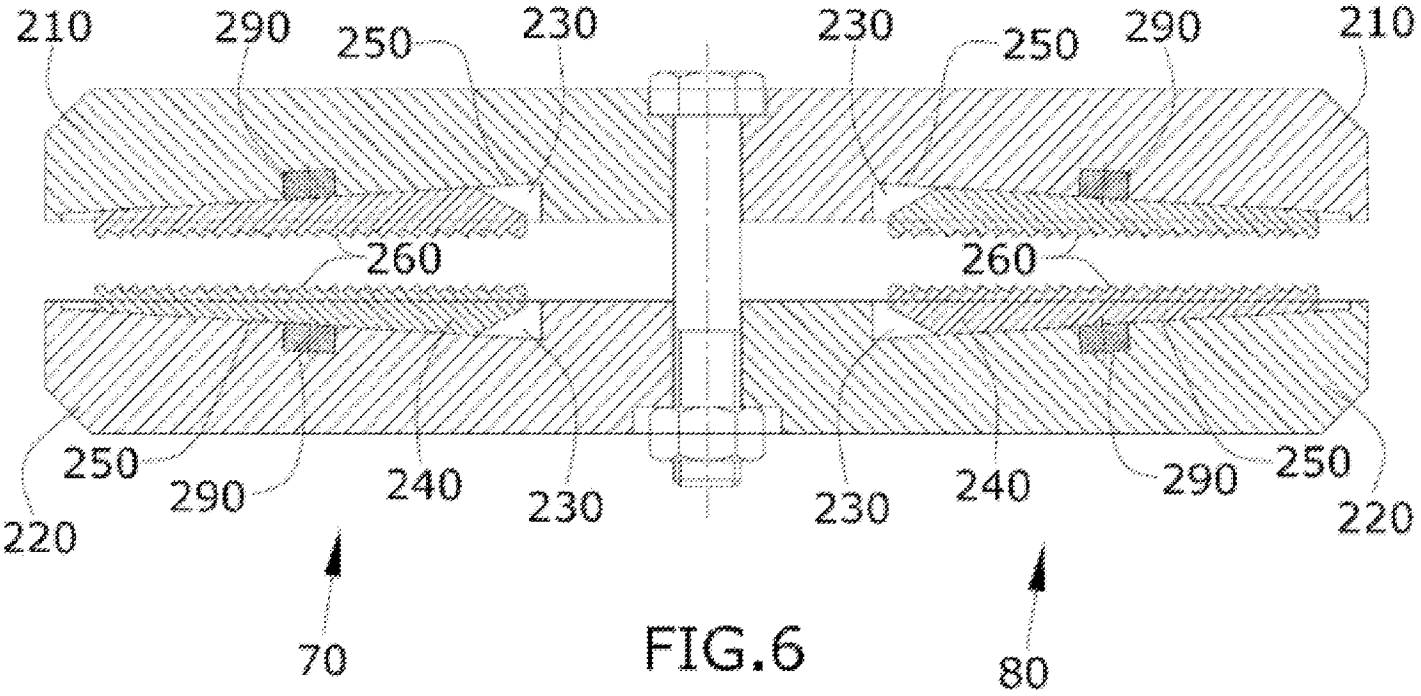
FIG. 6 shows a longitudinal cross-section view of the example embodiment shown in FIG. 5.

FIGS. 5 and 6 show an example embodiment of a tractor plate (200) that comprises:

- a support element (210, 220) that comprises a first part (210) and a second part (220) each of which are located on one face of the rail (1) at one end of it (1);
- each part of the support element (210, 220) comprises an internal cavity (230) in its face intended to be located adjacent to the rail (1), positioning the internal cavities (230) facing each other in the area of the rail (1) web (3);
- a first and a second rail (1) gripping element (240), each located in an internal cavity (230) in the support element (210, 220) such that the gripping element (240) can be slid with respect to the support element (210, 220) in the direction longitudinal to the rail (1).

Where the internal cavities (230) comprise an inclined surface (250) such that each internal cavity (230) reduces in depth longitudinally towards the end of the tractor plate (200) intended to house the end of the rail (1), with the gripping elements (240) and the internal cavities (230) configured in such a way that, on moving the gripping element (240) along the inclined surface (250) of the internal cavity (230) in the direction of pull of the rail (1), the gripping element (240) clamps onto the rail (1) web (3). More specifically, the internal cavity (230) is longer than the gripping element (240).

In order to minimise the slippage between the rail (1) web (3) and the gripping element (240), the surface (260) of the latter (240) intended to be in contact with the rail (1) web (3) comprises knurling.

In the example embodiment shown, the first part (210) and the second part (220) of the support element are independent symmetrical parts, each of which is located on one face of the rail (1) and these are fastened together by means of a bolt (221).

In the example embodiment the gripping element (260) is made from metal. Additionally, the tractor plate (200) comprises the corresponding magnetic elements (290) joined to the first (210) and the second (220) parts of the support element to retain the gripping elements (260) to attract them (260) to the support element, but at the same time to allow the gripping element (260) to slide with respect to the support element.

In addition to the above and with the purpose of providing greater clamping of the rail (1), as well as a larger contact area, also preventing tilting of the rail (1), the first (210) and second (220) parts of the support element comprise a recess (270) to house the rail (1) head (2) that, in the example shown in the figure, comprises knurling in part of its surface adapted to be in contact with the rail (1). More specifically, the surface (280) adapted to be in contact with the base of the rail (1) head (2) is the knurled surface.

The example embodiment shown in FIG. 6 refers to the case in which the tractor plate (200) comprises the corresponding support elements (70, 80) housing the corresponding gripping elements (240). In this way, the tractor plate (200) is adapted to joining two consecutive stretches of rail (1) together and enabling them (1) to be lowered linked together. More specifically, the support elements (70, 80) are located in a symmetrical arrangement with respect to a transverse axis such that one of the support elements (70) would be adapted to clasp a first rail (1) and the other support element (80) would be adapted to clasp a second rail (1) located in line with the first (1).

Similarly, a tractor plate (200) such as the one disclosed in FIGS. 5 and 6 would also be appropriate for joining a pulling machine (10) to the first stretch of rail (1) provided that the pulling machine (10) comprises a small stretch or section of rail (1) for joining to the rail (1). Optionally, the joint to the pulling machine (10) could be made with a bolt such that the tractor plate (200) would have a single support element (210, 220).

Figure 4:
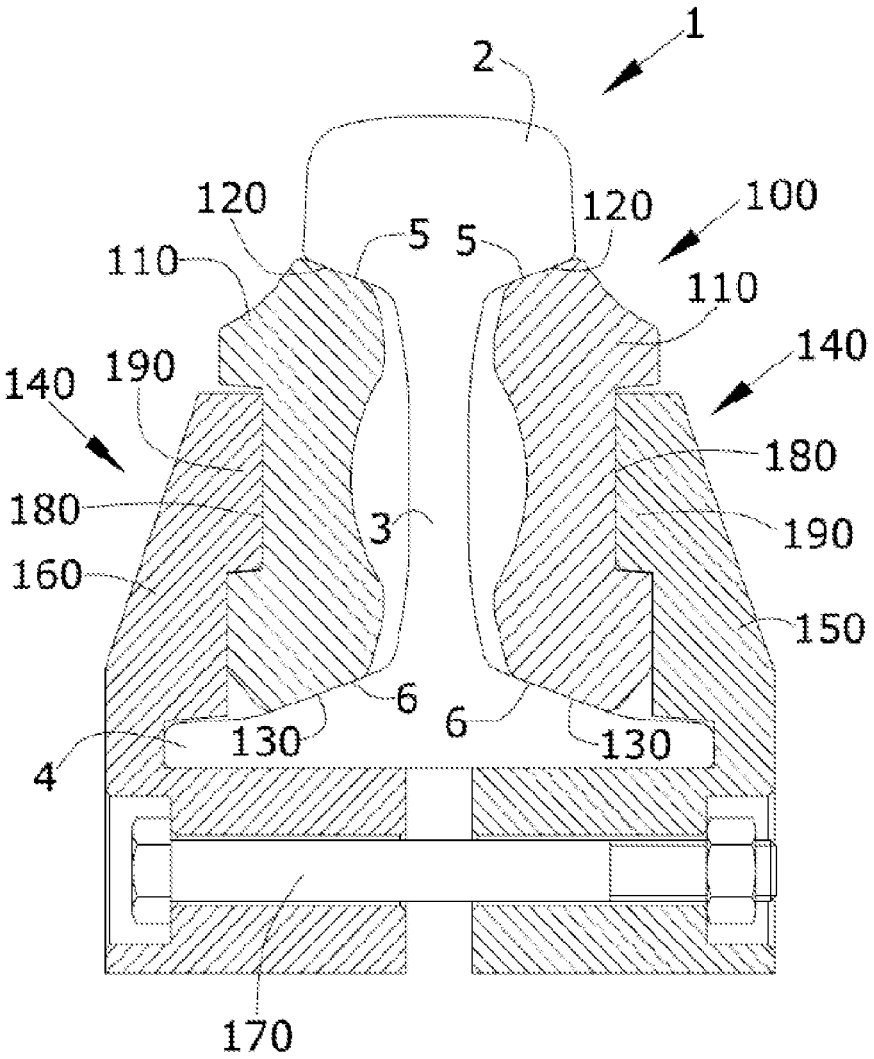
FIG. 4 shows a transverse cross-section view of an example embodiment of a joint plate.

FIG. 4 shows an example embodiment of a joint plate (100) where both stabilising parts (110) have a top (120) and bottom (130) internal surface located in contact with the base (5) of the head (2) and the base (6) of the foot (3) of one of the rails (1) to be joined.

Also represented in FIG. 4 is one of the clamping elements (140) linked therefore to one of the rails (1) to be joined. The clamping element (140) is positioned in contact with the external face of both stabilising parts (110) and presses the two stabilising parts (110) against the rail (1). More specifically, the clamping element (110) is located on the external face of both stabilising parts (110) at the height of the rail (1) web (3) in the corresponding recesses (180) for housing the corresponding projections (190) from the clamping element (140).

The clamping element (140) comprises an extension that clasps the rail (1) foot (4) and, therefore, surrounds it (4). Alternatively, the clamping element (140) may have an extension that clasps the rail (1) head (2).

In the example embodiment shown in FIG. 4, the clamping element (140) comprises the corresponding symmetrical parts (150, 160), each of which is located in contact with one of the stabilising parts (110) and, therefore presses it (110) onto the rail (1). To join the two symmetrical parts (150, 160), a clamping bolt (170) is positioned, which in the example embodiment shown goes through the two symmetrical parts (150, 160) passing the bottom part of the rail (1) foot (4).

Figure 7:
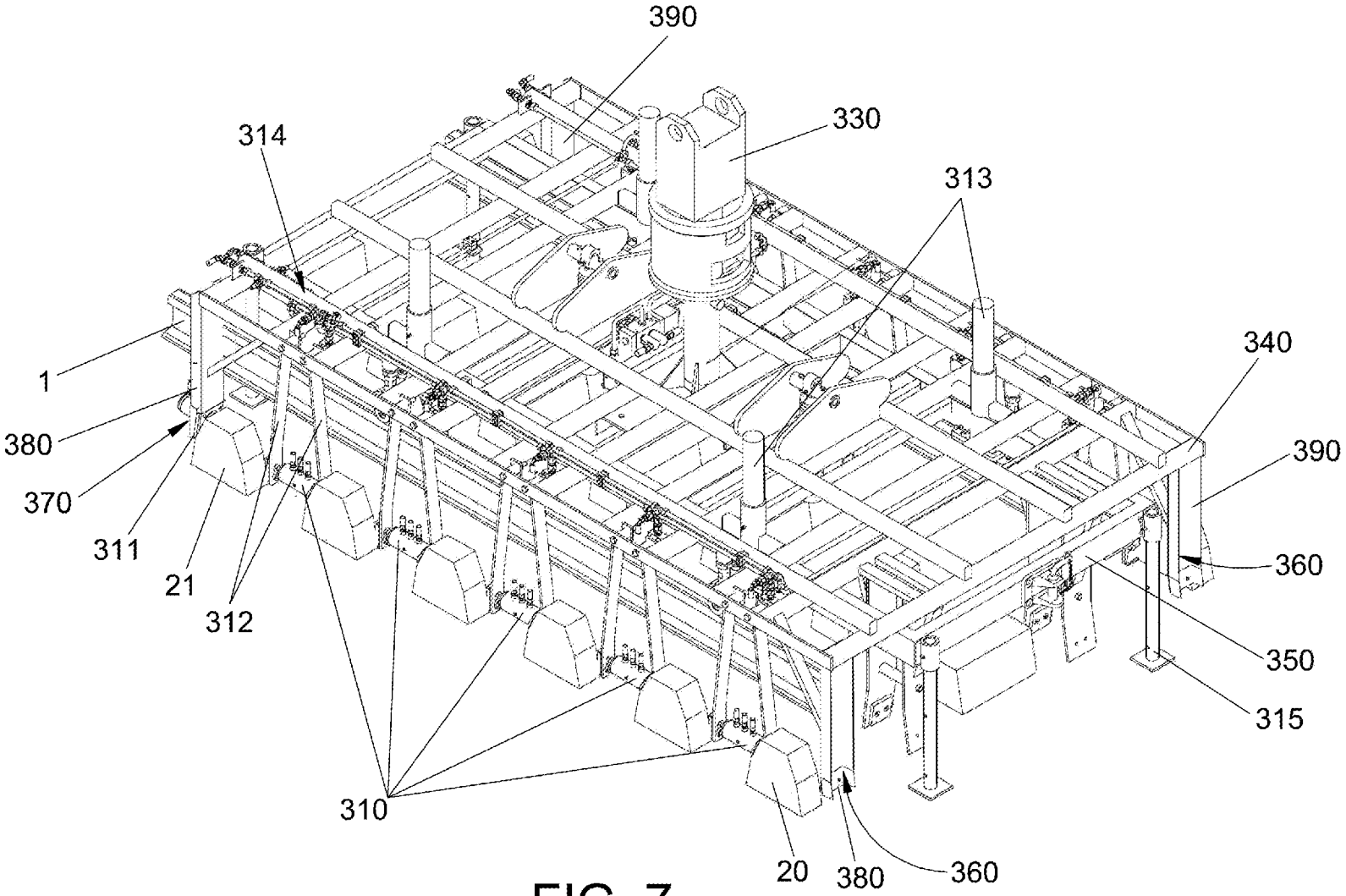
FIG. 7 shows a schematic view of an example embodiment of a squaring unit.

FIG. 7 shows an example embodiment of a sleeper squaring device that comprises:

- at least a first and second positioning element (310) adapted to be located between the same number of sleepers (20) and located at opposite ends of the sleepers (20) and parallel to the direction of the rail (1), where these positioning elements (310) extend in this direction;
- a frame (340) joined to the first and to the second positioning element (310);
- a first and a second stop (360, 370) joined to the frame (340), where each stop (360, 370) comprises a first part (380) and a second part (390) arranged facing the first and the second positioning element (310), in such a way that they are located on the external face of the two end sleepers (20, 21) to be positioned and where at least one of the first or second stops (360, 370) can be extended in the direction parallel to the rail (1); and
- where the first and the second positioning element (310) and the stop that can be extended (370) are configured such that in their simultaneous extension to a preset value, they push the sleepers (20) so as to square them (20).

More specifically, FIG. 7 represents an example embodiment that has a first and a second set of positioning elements (310); the first set of positioning elements (310) has five positioning elements (310) located at the ends of six beams (20) which are arranged aligned and equidistant and the second set has another five positioning elements (310) arranged at the opposite ends of these beams (20). In this way, six sleepers (20) can be squared in a single operation.

The positioning elements (310) are located parallel to the direction of the rail (1), i.e. perpendicular to the sleepers (20), and extend in that direction. More specifically, the positioning elements (310) included in the example embodiment comprise hydraulic cylinders.

The frame (340) shown in the figures can be raised such that the positioning elements (310) are inserted between the sleepers (20) by raising and lowering it. Other configurations would be possible, for example, that the positioning elements (310) are inserted in the direction parallel to the longitudinal axis of the sleepers (20) by means of articulated arms.

In the example embodiment shown in FIG. 7, the device comprises a first frame (340) to which the positioning elements (310) are joined and a second frame (350) which comprises means for support on the rails (1) and which is arranged connected to the first frame (340) such that the first frame (340) can be raised relative to the second frame (350) as the second frame (350) comprises guides (313) for raising and lowering the first frame (340). In the example embodiment shown, the means for supporting the second frame (350) on the rails (1) are wheels, which enables the device to be moved along the track.

Also represented in FIG. 7 are the first (360) and second stops (370) joined to the first frame (340). Each stop (360, 370) comprises a first part (380) and a second part (390) arranged facing the first and second set of positioning elements (310). The stops (360, 370) are located on the outside face of the end sleepers (20, 21).

In the squaring operation, one of the stops (360) is located in contact with the first sleeper (320). To do this, this first sleeper (20) must be aligned manually, as it is the reference for locating the device. The other stop (370) can be extended and in the example embodiment comprises a hydraulic cylinder. Manual alignment of the first sleeper (20) is performed solely with the first group of six sleepers (20), as in subsequent phases the last sleeper (21) will be the first sleeper (20) in the following phase.

The positioning elements (310) are arranged joined to the first frame (340) by means of extensions (312) for each one joined at their top ends to that frame (340) and at their bottom ends to the ends of the positioning elements (310), such that in the extended position of these positioning elements (310), this bottom end is located between the positioning elements (310) and the sleepers (20).

In order to cause the minimum possible damage to the sleepers (20), the extensions (312) comprise a shock absorbing element (311) on their face facing the sleepers (20), which can also be made available on the internal face of the stops (360, 370).

Also represented in FIG. 7 is the hydraulic facility (314) that enables the extension and retraction of the hydraulic cylinders.

The device also has an additional support element (315) which provides the assembly with stability.

The second frame (350) comprises means for coupling (330) it to a self-propelled machine that also has a hydraulic or pneumatic system that supplies the hydraulic (314) or pneumatic system referred to above. The self-propelled machine can be any machine capable of moving in the vicinity of the track and, therefore, there is no need for a device which necessarily needs to move along the track, which makes squaring operations more difficult and causes delays in them. Therefore, one of the steps in the track laying procedure which is the purpose of the invention can be the introduction of a self-propelled machine that comprises a squaring device as mentioned and the performing of this squaring.

Figure 8:
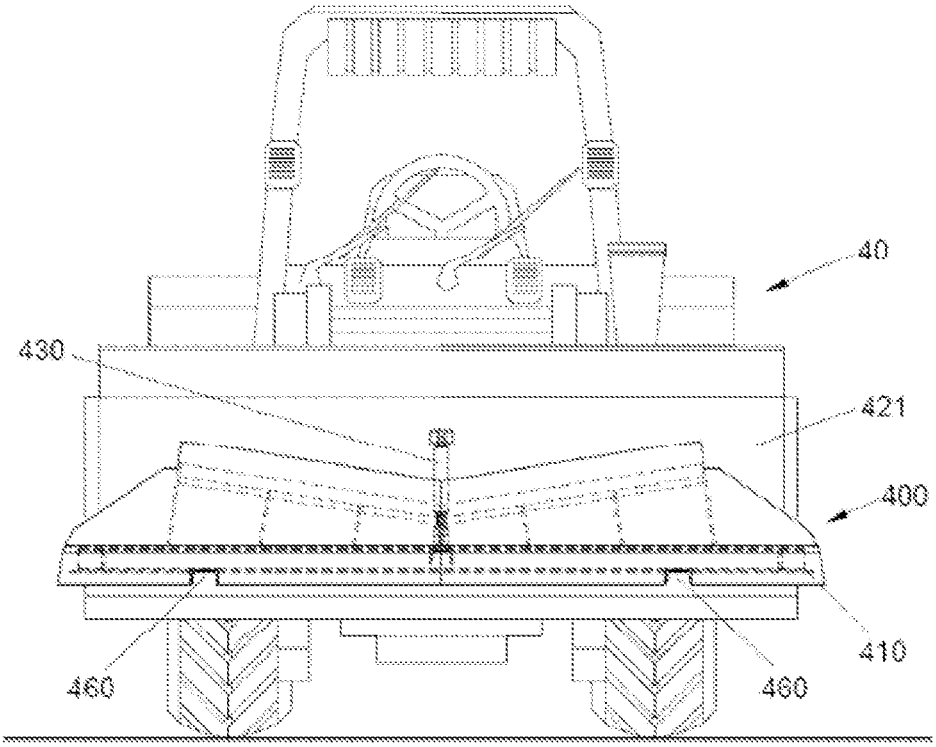
FIG. 8 shows a schematic view of an example embodiment of a profiling device.
Figure 9:
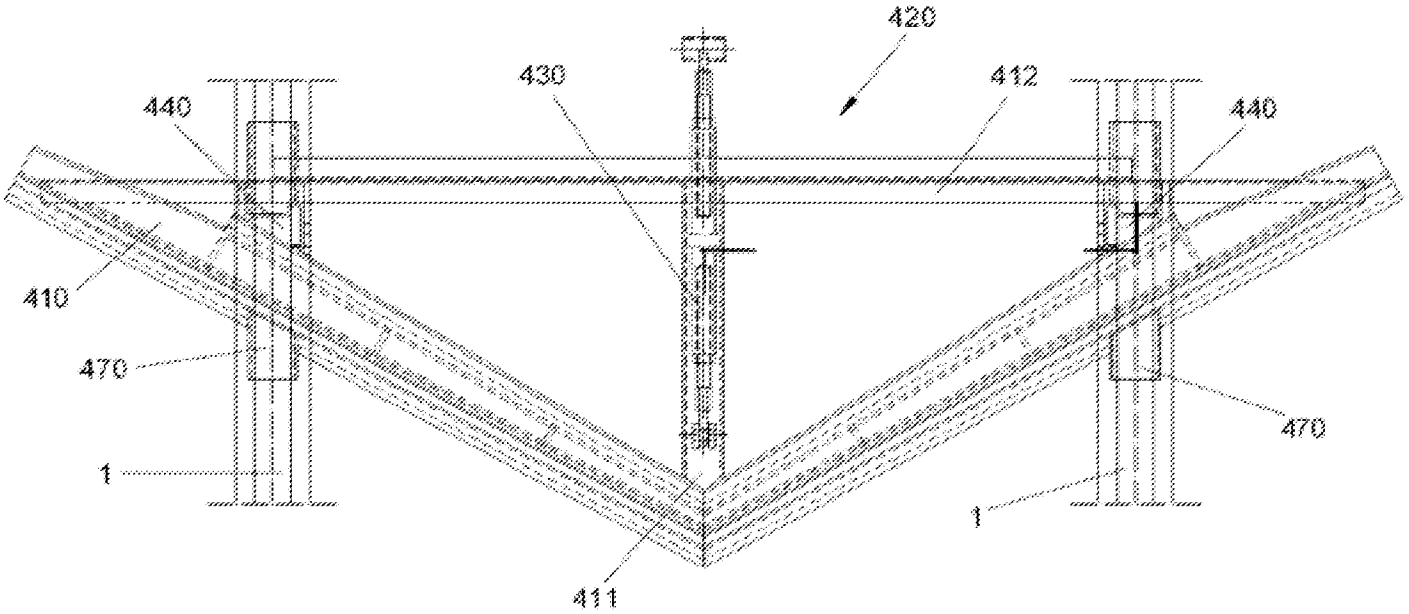
FIG. 9 shows a schematic plan view of the example embodiment of the profiling device corresponding to FIG. 8.

FIG. 8 shows an example embodiment of a profiling device (400). As can be seen in the figure, the device comprises the ballast ploughing element (410) which is symmetrical and wedge-shaped and comprises the corresponding apertures (460) in its bottom part to house the track rail (1) head (2). More specifically, the device comprises the corresponding U-profiles (470) coupled to the bottom part of the ploughing element (410) that define both apertures (460).

The frame (420) comprises a transverse profile (412) that extends between the two ends of the ploughing element (410), a central longitudinal profile (411) that extends between the transverse profile (412) and the centre of the ploughing element (410) and the U-profiles (470), which also define the apertures (460) which extend between the ploughing element (410) and the transverse profile (412).

The transverse profile (412) would be joined to the loader (421) of the earthmoving machine (40) represented in FIG. 8. This connection is made by welding the profiles that constitute the frame (420) to the loader (421) superstructure.

In order to be able to adjust the height and inclination of the ploughing element (410), the profiling device also comprises the extensible fixing element (430) that is joined by one of its ends to the frame (420), more specifically to the central longitudinal profile (411), and by its other end is joined to the earthmoving machine (40). The extensible fixing element (430) can regulate its length so as to make it possible to regulate the height and inclination of the ploughing element (410) and, therefore, enable regulation of the height of the apertures (460) above the rail (1).

The apertures (460) can comprise a rolling element, for example a set of rollers, to prevent scraping the rails (1).

In addition, the frame (420) comprises the corresponding wheels (440) adapted to run on the track rails (1).

The invention claimed is:

1. A procedure for laying railway tracks on a trackbed, the procedure comprising:

providing a track laying train (30) with a plurality of rails (1) to be laid in a laying area;

pulling a first pair of rails of the plurality of rails (1) from the track laying train (30) in a direction of pull;

joining the first pair of rails to a second, consecutive pair of rails of the plurality of rails (1) with a pair of tractor plates (200), each tractor plate (200) including a support having a first part (210) and a second part (220), and gripping elements (240), each gripping element (240) configured to slide with respect to the first and second parts (210, 220) in a longitudinal direction so that when the gripping element (240) is moved in the direction of pull, the gripping element (240) clamps on a web (3) of a respective one of the second pair of rails;

unloading the first and second pairs of rails joined by the tractor plates (200) from the track laying train (30) onto the trackbed;

squaring a plurality of sleepers (20) on the trackbed simultaneously with a squaring device, the plurality of sleepers (20) including a front sleeper (21), a rear sleeper, and at least one intermediate sleeper between the front sleeper (21) and the rear sleeper, the squaring device including a plurality of extensible positioning elements (310) located between the front sleeper (21) and the rear sleeper, wherein:

the plurality of extensible positioning elements (310) includes a first positioning element and a second positioning element arranged at opposite ends of the plurality of sleepers, the squaring device includes a frame (340) joined to the first and second positioning elements, the frame (340) includes a first stop (360) having a first part (380) and a second part (390) arranged adjacent a rear side of the rear sleeper and at opposite ends of the rear sleeper, the frame (340) includes a second stop (370) having a first part (380) and a second part (390) arranged adjacent a front side of the front sleeper (21) and at opposite ends of the front sleeper (21), the second stop (370) is extendable away from the first stop (360); and the first positing element, the second positioning element, and the second stop (370) are configured to extend simultaneously to square the plurality of sleepers (20);

after unloading, joining the first and second pairs of rails with a pair of joint plates (100), each joint plate (100) including first and second stabilising parts (110) located on opposite longitudinal sides of a respective rail of the first and second pairs of rails, with a top internal surface (120) and a bottom internal surface (130) of each stabilising part (110) located in contact with a head (2) of the respective rail and a foot (3) of the respective rail, wherein the first and second stabilising parts (110) are tightened onto the respective rail;

unloading ballast onto the trackbed;

tamping the first and second pairs of rails;

profiling the ballast with a profiling device (400) coupled to an earthmoving machine (40); and welding the first and second pairs of rails together.

2. The railway track laying procedure according to claim 1, wherein pulling the first pair of rails from the track laying train (30) includes joining an end of each rail of the first pair of rails to a pulling machine (10) that moves along the trackbed.

3. The railway track laying procedure according to claim 1, further comprising mounting an unloading tool (12) to the plurality of sleepers (20), the unloading tool (12) configured to guide the first and second pairs of rails during unloading.

4. The railway track laying procedure according to claim 1, wherein pulling the first pair of rails includes moving the track laying train (30) along an auxiliary track (60) parallel to the trackbed while ends of the first pair of rails are joined to a fixed point on the plurality of sleepers (20).

5. The railway track laying procedure according to claim 4, further comprising:

providing an unloading device (500) coupled to a plurality of auxiliary wagons (31) of the track laying train (30); and guiding the first and second pairs of rails through the unloading device (500).

6. The railway track laying procedure according to claim 5, wherein the unloading device (500) includes a plurality of transverse beams (501) each having first and second windows (502) configured to guide the first and second pairs of rails toward the trackbed, wherein a first transverse beam (501) of the plurality of transverse beams (501) is fixed to a first auxiliary wagon (31) of the plurality of auxiliary wagons (31), the first and second windows (502) of the first transverse beam (501) being disposed on opposite sides of a longitudinal axis of the track laying train (30), and wherein the windows of consecutive transverse beams (501) of the plurality of transverse beams (501) are positioned progressively closer to the trackbed in a direction transverse to the trackbed to guide the first and second pairs of rails toward the trackbed.

7. The railway track laying procedure according to claim 6, wherein the plurality of transverse beams (501) includes at least one adjustable beam in which the position of the first and second windows (502) is variable longitudinally along the adjustable beam.

8. A procedure for laying railway tracks on a trackbed, the procedure comprising:

providing a track laying train (30) with a plurality of rails (1) to be laid in a laying area;

pulling a first pair of rails of the plurality of rails (1) from the track laying train (30) in a direction of pull;

joining the first pair of rails to a second, consecutive pair of rails of the plurality of rails (1) with a pair of tractor plates (200), each tractor plate (200) including a support having a first part (210) and a second part (220), and gripping elements (240), each gripping element (240) configured to slide with respect to the first and second parts (210, 220) in a longitudinal direction so that when the gripping element (240) is moved in the direction of pull, the gripping element (240) clamps on a web (3) of a respective one of the second pair of rails;

unloading the first and second pairs of rails joined by the tractor plates (200) from the track laying train (30) onto the trackbed;

providing an unloading device (500) coupled to a plurality of auxiliary wagons (31) of the track laying train (30);

guiding the first and second pairs of rails through the unloading device (500);

squaring a plurality of sleepers (20) on the trackbed simultaneously with a squaring device, the squaring device including a plurality of extensible positioning elements (310) located between consecutive sleepers of the plurality of sleepers (20);

after unloading, joining the first and second pairs of rails with a pair of joint plates (100), each joint plate (100) including first and second stabilising parts (110) located on opposite longitudinal sides of a respective rail of the first and second pairs of rails, with a top internal surface (120) and a bottom internal surface (130) of each stabilising part (110) located in contact with a head (2) of the respective rail and a foot (3) of the respective rail, wherein the first and second stabilising parts (110) are tightened onto the respective rail;

unloading ballast onto the trackbed;

tamping the first and second pairs of rails;

profiling the ballast with a profiling device (400) coupled to an earthmoving machine (40); and welding the first and second pairs of rails together, wherein pulling the first pair of rails includes moving the track laying train (30) along an auxiliary track (60)

parallel to the trackbed while ends of the first pair of rails are joined to a fixed point on the plurality of sleepers (20), wherein the unloading device (500) includes a plurality of transverse beams (501) each having first and second windows (502) configured to guide the first and second pairs of rails toward the trackbed, wherein a first transverse beam (501) of the plurality of transverse beams (501) is fixed to a first auxiliary wagon (31) of the plurality of auxiliary wagons (31), the first and second windows (502) of the first transverse beam (501) being symmetrically disposed on opposite sides of a longitudinal axis of the track laying train (30), wherein the windows of consecutive transverse beams (501) of the plurality of transverse beams (501) are positioned progressively closer to the trackbed in a direction transverse to the trackbed to guide the first and second pairs of rails toward the trackbed, wherein the plurality of transverse beams (501) includes at least one adjustable beam in which the position of the first and second windows (502) is variable longitudinally along the adjustable beam, and wherein the adjustable beam is telescopically adjustable to vary the distance between the windows (502).

9. A procedure for laying railway tracks on a trackbed, the procedure comprising:

providing a track laying train (30) with a plurality of rails (1) to be laid in a laying area;

pulling a first pair of rails of the plurality of rails (1) from the track laying train (30) in a direction of pull;

joining the first pair of rails to a second, consecutive pair of rails of the plurality of rails (1) with a pair of tractor plates (200), each tractor plate (200) including a support having a first part (210) and a second part (220), and gripping elements (240), each gripping element (240) configured to slide with respect to the first and second parts (210, 220) in a longitudinal direction so that when the gripping element (240) is moved in the direction of pull, the gripping element (240) clamps on a web (3) of a respective one of the second pair of rails;

unloading the first and second pairs of rails joined by the tractor plates (200) from the track laying train (30) onto the trackbed;

providing an unloading device (500) coupled to a plurality of auxiliary wagons (31) of the track laying train (30);

guiding the first and second pairs of rails through the unloading device (500);

squaring a plurality of sleepers (20) on the trackbed simultaneously with a squaring device, the squaring device including a plurality of extensible positioning elements (310) located between consecutive sleepers of the plurality of sleepers (20);

after unloading, joining the first and second pairs of rails with a pair of joint plates (100), each joint plate (100) including first and second stabilising parts (110) located on opposite longitudinal sides of a respective rail of the first and second pairs of rails, with a top internal surface (120) and a bottom internal surface (130) of each stabilising part (110) located in contact with a head (2) of the respective rail and a foot (3) of the respective rail, wherein the first and second stabilising parts (110) are tightened onto the respective rail;

unloading ballast onto the trackbed;

tamping the first and second pairs of rails;

profiling the ballast with a profiling device (400) coupled to an earthmoving machine (40); and welding the first and second pairs of rails together, wherein pulling the first pair of rails includes moving the track laying train (30) along an auxiliary track (60) parallel to the trackbed while ends of the first pair of rails are joined to a fixed point on the plurality of sleepers (20), wherein the unloading device (500) includes a plurality of transverse beams (501) each having first and second windows (502) configured to guide the first and second pairs of rails toward the trackbed, wherein a first transverse beam (501) of the plurality of transverse beams (501) is fixed to a first auxiliary wagon (31) of the plurality of auxiliary wagons (31), the first and second windows (502) of the first transverse beam (501) being symmetrically disposed on opposite sides of a longitudinal axis of the track laying train (30), wherein the windows of consecutive transverse beams (501) of the plurality of transverse beams (501) are positioned progressively closer to the trackbed in a direction transverse to the trackbed to guide the first and second pairs of rails toward the trackbed, wherein the plurality of transverse beams (501) includes at least one adjustable beam in which the position of the first and second windows (502) is variable longitudinally along the adjustable beam, and wherein the first and second windows (502) on the adjustable beam are positionable at preset positions along a length of the adjustable beam to vary a distance between the windows (502).

10. The railway track laying procedure according to claim 6, wherein each of the plurality of transverse beams (501) is movable between a plurality of preset positions with respect to a vertical bar (503).

11. The railway track laying procedure according to claim 6, wherein the first and second windows (502) are located on mountings (504) of different thicknesses such that the first and second windows (502) are positioned at different heights with respect to the transverse beam (501).

12. The railway track laying procedure according to claim 1, wherein the first pair of rails is joined to the second pair of rails by the tractor plates (200) such that the first and second pairs of rails are positioned on opposite sides of the tractor plates (200).

13. The railway track laying procedure according to claim 1, wherein unloading the first and second pairs of rails includes unloading the first and second pairs of rails onto the plurality of sleepers (20) or unloading the first and second pairs of rails alongside the plurality of sleepers (20).

14. The railway track laying procedure according to claim 1, wherein gripping elements (240) are each located in an internal cavity (230) in the support;

wherein the internal cavities (230) each include an inclined surface (250) such that each internal cavity (230) reduces in depth longitudinally towards an end of the tractor plate (200), and wherein each internal cavity (230) is configured to receive an end of a rail (1), with the gripping elements (240) and the internal cavity (230) configured in such a way that, on moving the gripping element (240) along the inclined surface (250) of the internal cavity (230) in the direction of pull, the gripping element (240) clamps onto a web (3) of the rail.

15. The railway track laying procedure according to claim 1, wherein squaring the plurality of sleepers (20) includes manually squaring the rear sleeper, the rear sleeper in contact with the first stop (360), repositioning the squaring device such that the first stop (360) engages the front sleeper (21), and after repositioning, squaring a second plurality of sleepers (20) simultaneously with the squaring device.

16. The railway track laying procedure according to claim 1, wherein each joint plate (100) includes first and second clamping elements (140) configured to press the first and second stabilising parts (110) against the respective rail.

17. The railway track laying procedure according to claim 1, wherein the profiling device (400) comprises:

a ballast ploughing element (410) which is symmetrical with respect to a longitudinal axis and which extends between the pairs of rails, the ballast ploughing element (410) including two apertures (460);

a frame (420) joined to the ploughing element (410) and configured for coupling to an earthmoving machine (40); and an extensible fixing element (430) including a first end coupled to the frame (420) and a second end coupled to the earthmoving machine (40), wherein the profiling the ballast includes positioning the ballast ploughing element (410) such that the pairs of rails are aligned with the respective apertures (460), and moving the ballast ploughing element (410) with the earthmoving machine (40) to drag the unloaded ballast along the trackbed.

* * * * *